US005285733A

United States Patent [19]

Waibel

[11] Patent Number: 5,285,733

[45] Date of Patent: Feb. 15, 1994

[54] HEIGHT-ADJUSTABLE TABLE WITH A LINEAR OR STRAIGHT GUIDE

[76] Inventor: Walter Waibel, Birkenstr. 19, 8312 Dingolfing, Fed. Rep. of Germany

[21] Appl. No.: 840,067

[22] Filed: Feb. 25, 1992

[30] Foreign Application Priority Data

Mar. 1, 1991 [DE] Fed. Rep. of Germany ..... 4106610

[51] Int. Cl.[5] ..... A47B 9/00

[52] U.S. Cl. ..... 108/144; 108/50; 248/188.5

[58] Field of Search ..... 108/144, 148, 106; 248/188.5, 188.2, 412, 413, 157

[56] References Cited

U.S. PATENT DOCUMENTS

| | | | |
|---|---|---|---|
| 1,631,513 | 6/1927 | Berry | 248/188.5 |
| 2,547,296 | 4/1951 | White | 108/144 |
| 4,080,080 | 3/1978 | Cisler | 248/108.5 X |
| 4,378,173 | 3/1983 | Hopwell | 248/188.5 X |
| 4,667,605 | 5/1987 | Bastian | 248/188.5 X |
| 4,688,748 | 8/1987 | Pruyser . | |
| 4,711,184 | 12/1987 | Wallin et al. | 108/144 |
| 4,875,418 | 10/1989 | Moeckl et al. | 108/50 |
| 4,879,955 | 11/1989 | Moll et al. | 108/50 |

FOREIGN PATENT DOCUMENTS

| | | |
|---|---|---|
| 2250444 | 4/1974 | Fed. Rep. of Germany . |
| 3231802C2 | 3/1982 | Fed. Rep. of Germany . |
| 3625136 | 12/1987 | Fed. Rep. of Germany . |
| 9011059.5 | 7/1990 | Fed. Rep. of Germany . |
| 9013387 | 2/1991 | Fed. Rep. of Germany . |

*Primary Examiner*—Jose V. Chen

*Attorney, Agent, or Firm*—Nixon & Vanderhye

[57] ABSTRACT

In a linear or straight guide (2) for a height-adjustable table, a stationary frame component (4) and a moving frame component (6) are in form-fit sliding contact in the manner of a sliding guide, with the moving frame component (6) being guided with a little play in the stationary frame component (4) designed as a hollow profile. A height-adjustable table equipped with this linear or straight guide is characterized in particular by the extremely quick damping of impact-induced horizontal oscillatory movements of the table top in longitudinal direction.

6 Claims, 3 Drawing Sheets

HEIGHT-ADJUSTABLE TABLE WITH A LINEAR OR STRAIGHT GUIDE

Figure 1:
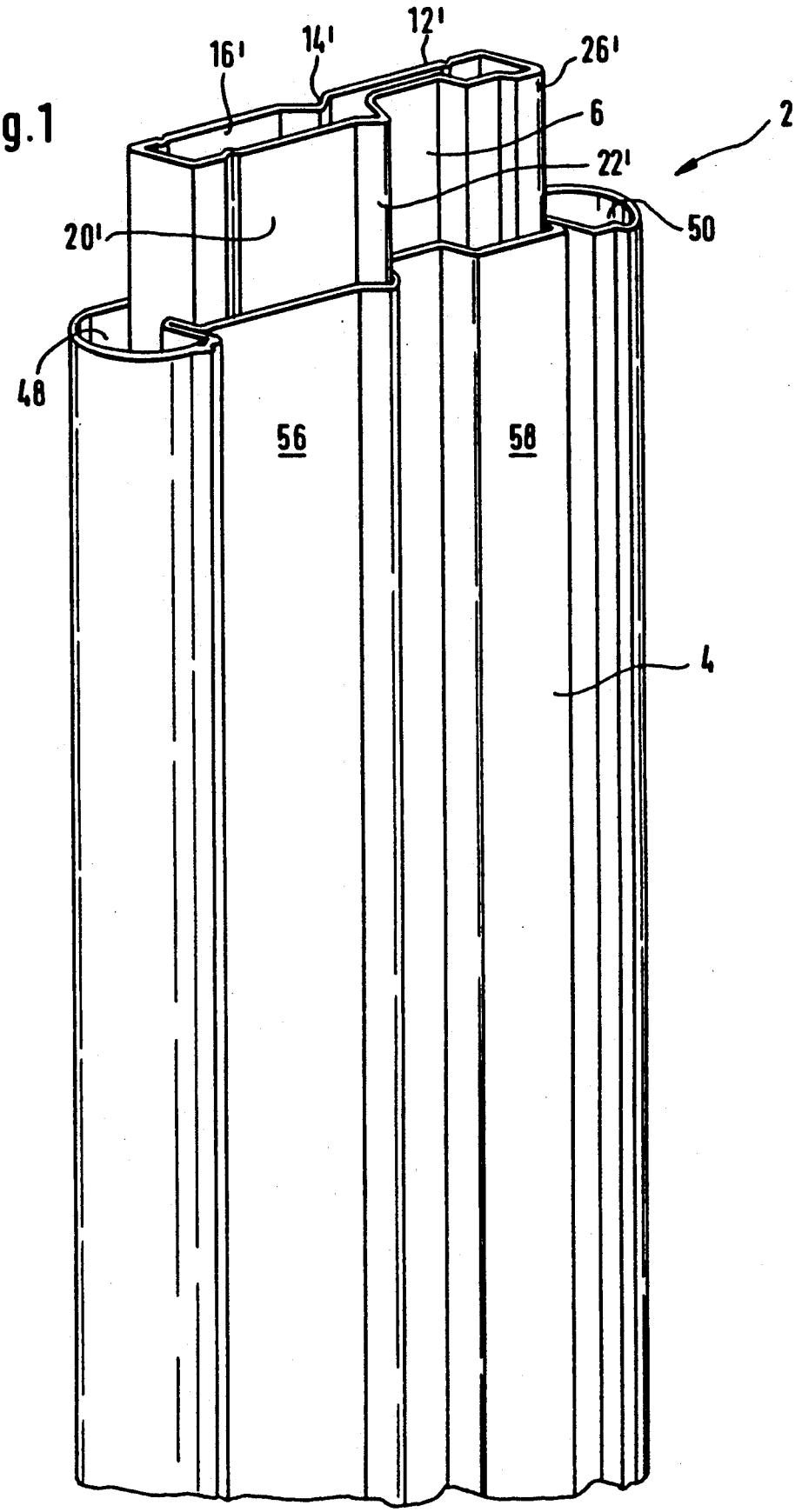

Subject of the invention is a height-adjustable table with a linear or straight guide, in particular an office table, laboratory table or work table.

Height-adjustable tables are known in a design which enables a frame component supporting the table top to be adjusted by sliding relative to a stationary, floor-standing frame component so that the vertical position of the table top can be adapted to the respective requirements.

In this connection it is known from DE-GM 90 11 059 how to provide a linear or straight guide between the stationary frame component or frame substructure and the frame component which supports the table top and can be moved and adjusted relative thereto. The linear or straight guide for this purpose can be, for example, a longitudinal guide in the manner of a tongue-and-groove connection, a Vee-guide or similar.

Particularly for high-grade desks or work tables it is an advantage to manufacture at least the stationary frame component as solidly as possible, e.g., from steel or similar, in order to increase the overall stability of a table thus equipped and at the same time to dampen any recoil of the table top in particular as quickly as possible should it be struck on the side. The use of steel or a similar metallic material usually makes it necessary to perform welding jobs in the course of the production and the accompanying thermal loading of the material can result in slight deformation in the area of the linear or straight guide so that refinishing operations are necessary in order to ensure perfect guidance without too much play and without clamps between the stationary frame components and the moving frame component. These refinishing operations can take relatively elaborate forms in practice.

Furthermore, dovetail guides, Vee-guides or similar of the type familiar from machine tool construction are relatively elaborate in their production due to their very exact surface with minimum tolerances and for this reason are by and large disqualified for use in furniture making, particularly since the types of guides from machine tool construction would invest the finished item of furniture, e.g. a desk, with the aesthetically unattractive character of an item of technical equipment or machine, which would be most detrimental to an item of representative furniture.

A table with a linear or straight guide known from DE-GM 90 13 387 largely solves the above mentioned problems, i.e. with the linear or straight guide according to DE-GM 90 13 387 it is possible to design height-adjustable tables that are aesthetically attractive and of light design, with the possibility of setting and adjusting the light or tight running of the guide at will and with no need any longer of elaborate refinishing operations in the area of the guide. This is due by providing wedge-shaped or triangular guide rails which can be set section by section in their relative positions and contact pressures by a large number of setting screws arranged in the vertical direction of the guide so that tolerance deviations on the one hand and light or tight running on the other side can be adjusted at will.

Higher demands are placed on high-grade desks or work tables inasmuch as the table top is allowed to oscillate only briefly after being struck on the side, i.e. following an impact in the area of one of the table top's sides. This means that the horizontal oscillation of the table top triggered by the lateral impact has to be dampened as quickly as possible. Up until now practical efforts to achieve this damping of the table top in as short a time as possible entailed giving the table substructure as solid and heavy a design as possible, with additional bracing measures introduced between the table substructure, the base and the table top. One known measure, for example, is to equip the longitudinal side of the table top facing away from the sitting side with a vertically arranged back panel, i.e. a back panel which is vertical to the table top and points in downward direction, as a means of bracing the entire table substructure in longitudinal direction.

Such elaborate struts and especially back panels that are fastened to the table top as well as to the table substructure cannot be used on height-adjustable tables for design reasons, because then it would no longer be possible to adjust the table height. To be able to dampen longitudinal oscillations of the table top as quickly as possible, it has been customary up until now to manufacture the linear or straight guides for such height-adjustable tables are precisely as possible and without play, thus making them tight-running at times, because it was hoped to obtain an increase in stability from an exact and zero-play guidance of the moving frame component along the stationary floor-standing frame component. The subject of DE-GM 90 13 387 mentioned at the beginning was developed, for example, in the course of these efforts.

In practice it has turned out, however, that in spite of the high design outlay aimed at obtaining as near to zero-play guidance as possible in the area of the linear or straight guide the table top on height-adjustable tables equipped with such virtually zero-play guides still reacts very sensitively to impact loads, i.e. that it is relatively unstable after strong and prolonged oscillation amplitudes, a circumstance that is felt to be extremely bothersome and determined with a view to the representative character of such a table as well as with regard to aspects of ergonomics and occupational medicine.

By contrast, the purpose of the invention under discussion is to design a height-adjustable table, in particular an orifice, laboratory or work table, in accordance with the characterizing clause of claim 1 in such a way that the oscillations of the table top and its complete base caused by a lateral impact against the edge of the table top are minimized.

This problem is solved in accordance with the invention.

In surprising fashion the solution results in the oscillations introduced into the table top dying down extremely quickly without any special design effort in the area of the linear or straight guide, thus preventing any protracted and pronounced oscillation of the table top or the moving table superstructure with its unstabilizing effect.

According to the current state of knowledge, the mechanisms which minimize table top oscillations are still not completely and comprehensively clarified. There are grounds for believing, however, that designing both the stationary and the moving frame component as a thin-walled hollow profile results in a certain oscillation isolation of the stationary frame component from the moving frame component, since the hollow profile walls permit local deformation which impede the transmission of oscillatory energy between the hollow profiles. This oscillation isolation is further reinforced by the play between the hollow profiles which is necessary for obstruction-free movement.

Past efforts to produce near-zero-play guides between the stationary and moving frame components resulted in the mass of the stationary frame component being integrated in the oscillating system of the complete table; this gave rise to a good oscillating system, with table legs that stood a long way from the table top and which were excited to pronounced transverse oscillations by impact loads. The oscillation isolation leads to a drastic decrease in the oscillation-relevant length of the table legs and hence to a corresponding reduction of the capacity for oscillation. Furthermore, the limited relative mobility and local deformability of the hollow profiles results in an internal damping of the oscillations so that they die down quickly.

In spite of the slight play between the stationary and the moving guide surface, the height-adjustable table with linear or straight guide in accordance with the invention stands securely in the static state and without bothersome tilting movements in the area of the linear or straight guide, because thanks to designing the stationary frame component and the moving frame component as hollow profiles with mutually complementary cross-sections it is possible to obtain a secure vertical guide that is capable of absorbing all load or tilting moments.

Advantageous further developments of the invention result from the sub-claims.

If the moving frame component is guided in the stationary frame component, the moving frame component will be enclosed by the stationary frame component and so will be reliably supported against all forces which act upon or are introduced into the linear or straight guide on a plane vertical to the guiding direction of the linear or straight guide, thus ensuring upright stability of the height-adjustable table, including when the respective table top is at its highest vertical position. This also makes it possible in particular to use the outer stationary frame component, which is unaffected by the adjusting movement in vertical direction, for hanging up base cabinets or for providing vertical interlinks with neighboring items of furniture which can remain at the same unchanged height whenever the height of table top is adjusted.

If the hollow profiles of the stationary frame component and the moving frame component form a number of supporting areas, the supporting characteristics of the linear or straight guide relative to all arising loads is further improved.

If most guide surfaces are designed to absorb mutually vertical forces acting on a plane vertical to the direction of guidance the linear or straight guide is able in advantageous manner to absorb in particular the two main loads which act on it when using a table thus equipped, namely a bending moment produced by loading the table top on one of its longitudinal sides, and an additional moment when the table is loaded in the table top plane across the direction of the table top.

If sections of the stationary guide surface and the complementary sections of the moving guide surface have a cross-section of triangular or wedge shape an additional bracing against forces acting across the wedge direction is achieved in advantageous manner. Furthermore, the wedge shape enables the guide surfaces of the hollow profiles to slide smoothly over each other when forces arise in the main axes of the table. This results in an additional damping of oscillations.

If, the stationary frame component features cable guide pockets or ducts that are formed on a side of the hollow profile looking away from the guide surfaces, it is an easy matter to electrify the table in accordance with the invention, i.e. to equip it with heavy or light current leads, computer leads, telephone leads or similar, in which case these cables and leads lie outside the actual guiding area with the sliding surface and so cannot be damaged.

If an adjusting device for setting the running characteristic of the linear or straight guide is arranged between the stationary frame component and the moving frame component the light or tight running of the linear or straight guide can be set in the factory to any desired value. Nevertheless, the oscillation isolation due to the slight design-induced play is maintained as the result of the relatively slight local deformability of the hollow profile walls in the area of the adjusting device.

If, the adjusting device is formed in this case by a setting screw which can be used to mutually brace the two frame components, the ideal running characteristic of the linear or straight guide can be obtained at low cost but with high precision.

If at least some parts of the guide surfaces are coated with an anti-friction covering the movement sequences in the linear or straight guide will be optimized as a whole because the wear and the noise caused by friction are also reduced. This can also result in a further improvement of the oscillation damping.

Further details, aspects and advantages of the invention under consideration are derived from the following description which makes reference to the drawing.

Figure 2A:
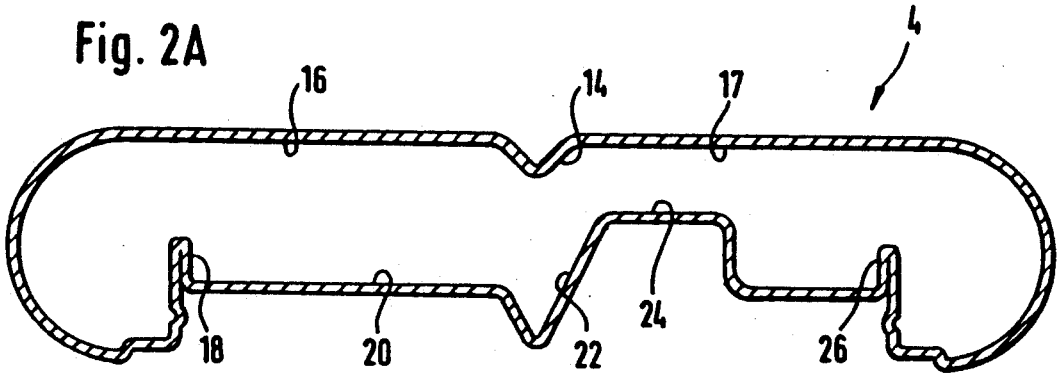
Figure 2B:
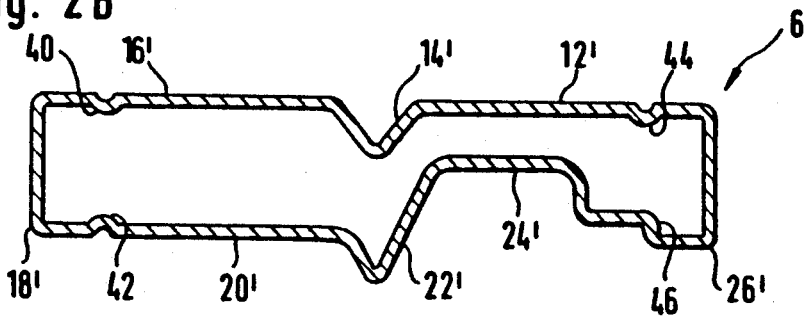
Figure 2C:
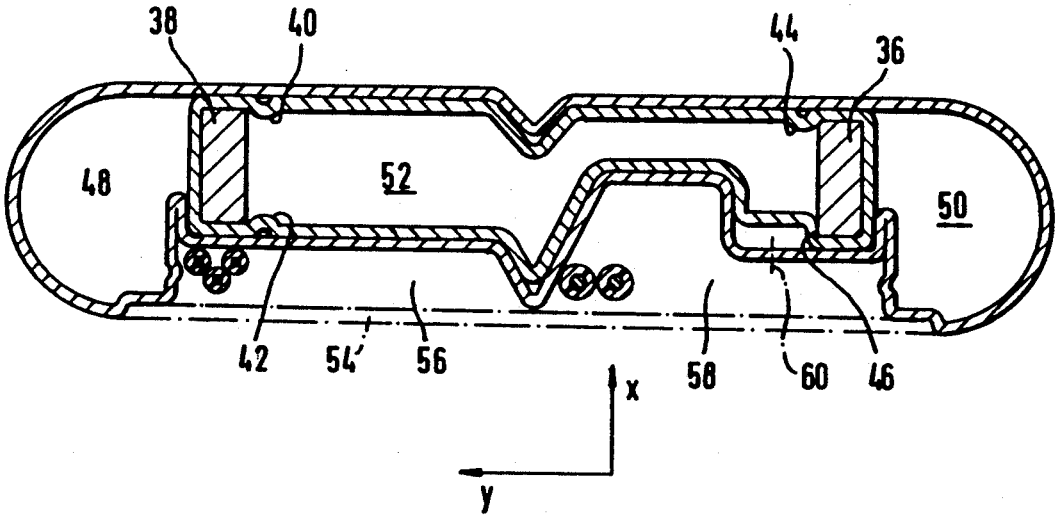

The drawing shows:

FIG. 1: an exploded cross-section through the stationary and the moving frame component in accordance with one of the preferred arrangements of the invention under consideration;

FIG. 2A: A cross-section through the stationary frame component;

FIG. 2B: A cross-section through the moving frame component;

FIG. 2C: A cross section through a stationary and moving frame component in the assembled state; and FIG. 3: An exploded view of one application option for the table with a linear or straight guide in accordance with the invention.

Figure 3:
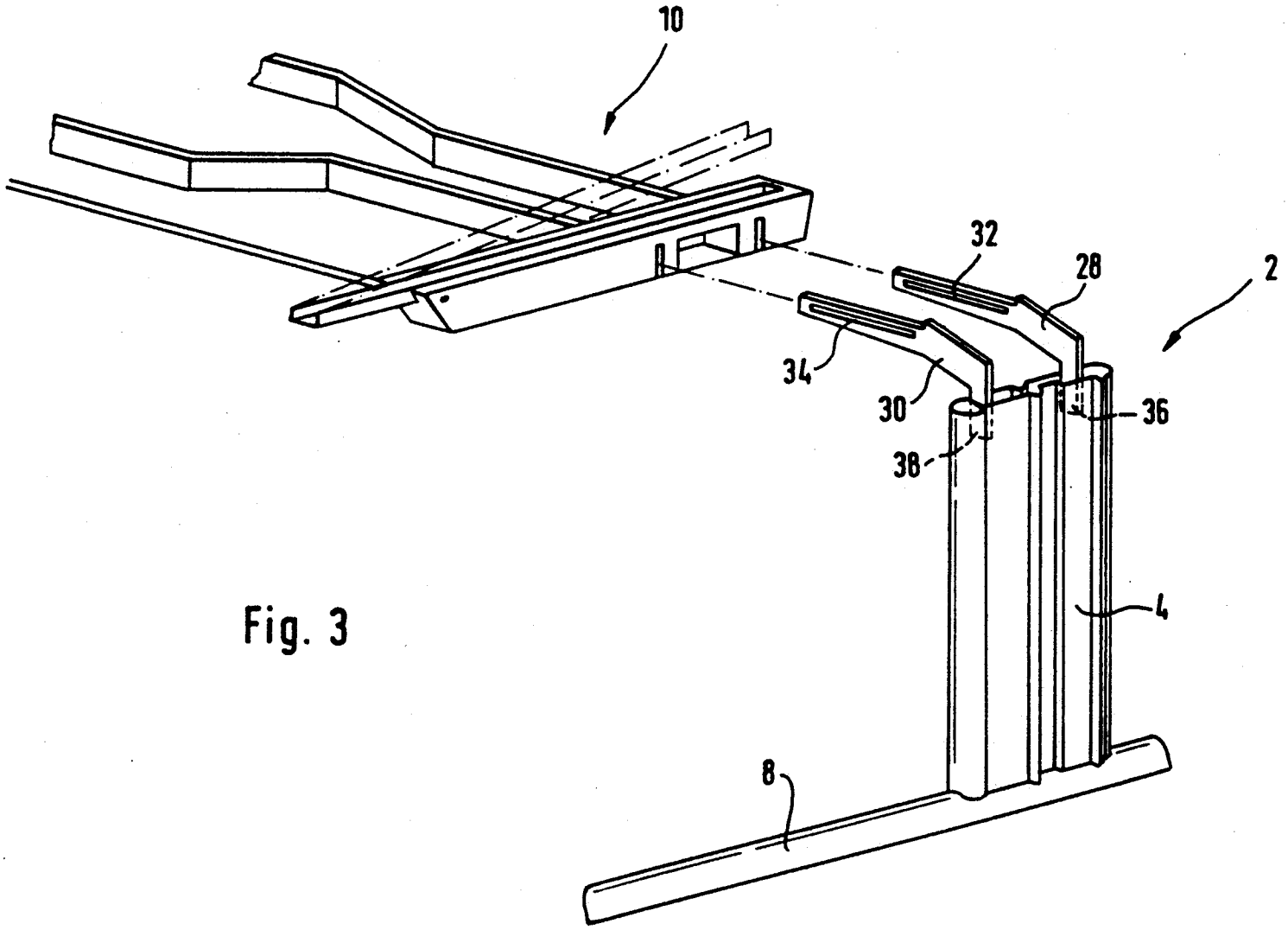

The following FIGS. 1 to 3 illustrate one preferred arrangement of a linear or straight guide (hereinafter called "guide").

As is best seen in FIGS. 1 and 2A to 2C, a guide marked with reference number 2 consists mainly of two parts, namely a stationary frame component 4 and with it a moving frame component 6. The stationary frame component 4 is supported on the floor by an appropriately shaped leg 8 as shown in FIG. 3. The moving frame component 6 supports a table substructure 10 which serves in turn to support a table top, as will be explained in closer detail.

In accordance with FIGS. 1 and 2A to 2C the stationary frame component 4 and the moving frame component 6 are designed as hollow profiles with the cross sections illustrated in FIGS. 2A and 2B. The cross-sectional shapes of the frame components 4 and 6 are mutually complementary inasmuch as the moving frame component 6 is accommodated in the stationary frame component 4 in the manner of a sliding guide as shown in FIGS. 1 and 2C. For this purpose the frame components 4 and 6 possess guide surfaces, with the stationary guide surfaces on the stationary frame component 4 being formed by the surface or wall sections 12, 14, 16, 18, 20, 22, 24 and 26 shown in FIG. 2A. In similar manner the moving frame component 6 possesses complementarily shaped surface or wall sections 12', 14', 16', 18', 20', 22', 24' and 26' which rest against the sections 12 to 26 of the stationary frame component 4. The arrangement between the surface sections of the stationary frame component 4 and those of the moving frame component 6 is produced as shown in FIG. 2C, with the surface sections 12 and 12', and 16 and 16', 20 and 20', and 24 and 24' resulting in a bracing of the moving frame component 6 in the stationary frame component 4 against tilting moments in the line of arrow X in FIG. 2C, whereas the arrangement between the surface sections 14 and 14', 18 and 18', 22 and 22', and 26 and 26' results in a bracing of the moving frame component 6 in the stationary frame component 4 against tilting moments in the line of arrow Y in FIG. 2C.

An additional reinforcement of the guide of the moving frame component 6 in stationary frame component 4 in the line of arrow Y in FIG. 2C is produced by the surface or wall sections 14 and 14' as well as 22 and 22', which have the triangular or wedge shape illustrated in FIGS. 2A and 2B.

The dimensions of the moving frame component 6 and the stationary frame component 4 with regards to the position and arrangement of the surface sections 12 to 26 and 12' to 26' respectively are selected for the guide of the moving frame component 6 to run relatively lightly in the stationary frame component 4, i.e. the frame component 6 has a certain—albeit slight—play inside frame component 4.

The top end of the moving frame component 6 shown in FIG. 1 serves to accommodate or fasten connectors with which the moving frame component 6 can be fastened to the table substructure 10. FIG. 3 shows that for this purpose there are angular supporting rails 28 and 30, each of which has a mainly horizontally arranged sword-like plug-in part 32 and 34 that can be inserted in suitably dimensioned locating holes in the table substructure and fastened there. Furthermore, each supporting rail 28 and 30 has a vertically arranged fastening section with which the supporting rails 28 and 30 can be fastened to the moving frame component 6.

For this purpose, as FIG. 2B shows, the cross section of the moving frame component 6 features noses 40, 42 and 44 as well as a step-shaped shoulder 46, enabling the fastening section 38 of the supporting rail 30 to be fixed in the moving frame component 6 in interaction with the nose 40 and 42 and enabling the fastening section 36 of the supporting rail 28 to be fixed in the moving frame component 6 in interaction with nose 44 with the shoulder 46. The fastening sections 36 and 38 are then additionally fastened to the moving frame section 6 by welding, screwing or similar.

With regards to further details of the connection between the table substructure 10 and the moving frame component 6, attention is drawn to German paten application P 41 06 611.1 from the same applicant and entitled "Table Base". Full reference is made herewith to the contents disclosed therein. The above identified German Patent application P 41 06 611.1 corresponds to U.S. patent application Ser. No. 840,066 titled TABLE BASE, naming as inventor WAIBEL, Walter, and filed on even date herewith, the subject matter of which is incorporated herein by reference.

With both stationary frame component 4 and the moving frame component 6 being designed as hollow profiles, two hollow spaces 48 and 50 remain in the stationary frame component 4 and a further hollow space 52 remains in the moving frame component 6 when the moving frame component 6 is inserted as shown in FIG. 2C. These hollow spaces 48, 50 and 52 are intended in particular for locating appropriate actuating mechanisms with which the moving frame component 6 can be moved relative to the stationary frame component 4, thus enabling the table substructure to be adjusted in height. Possible actuators for adjusting the moving frame component 6 relative to the stationary frame component 4 include, for example, spindle actuators or cable-operated mechanisms. It is particularly advantageous to use a lifting mechanism in accordance with DE-GM 90 11 059 by the same applicant, to which full reference is made herewith to the contents disclosed therein.

Furthermore, as can best be seen in FIGS. 2A and 2C, the stationary frame component 4 is profiled in the area of the surface or wall sections 20, 22 and 24 in such a way as to create cable guide pockets or ducts 56 and 58 in combination with a panel 54 (FIG. 2C) to be fitted in this area. The cable guide ducts 56 and 58 are separated from each other by the projecting wall section 22 which also gives support to the panel 54 so that, for example, the cable guide duct 56 can be used to accommodate light-current leads, i.e. telephone and/or computer cables, while the cable guide duct 58 can be used to accommodate electric supply cables. In this way signal leads are unaffected by power cables. Furthermore, with the cable guide ducts 56 and 58 being separated from the hollow spaces 48, 50 and 62, in which the setting actuators for adjusting the moving frame component 6 relative to the stationary frame component 4 are located or can be located, and with no relative movements taking place between the moving frame component 6 and the stationary frame component 4 in the area of the cable guide ducts 56 and 58, the leads and cables laid or arranged in the ducts 56 and 58 are protected against damage.

The wall sections 12 to 26 and 12' to 26', which are in sliding contact with each other, can be provided with a coating of a material able to lower the sliding friction between the moving frame component 6 and the stationary frame component 4, e.g. with PTFE plastic. This can prolong the life of the complete guide since wear, sliding noises and similar are reduced.

The stationary frame component 4 and the moving frame component 6 are accordingly dimensioned for the moving frame component 6 to be held in a form fit in the stationary frame component 4 in the manner of a sliding guide; this form-fit guidance of the moving frame component 6 has a certain—albeit slight—play. If required, it is possible to provide a setting or adjusting device 60 consisting, for example, of a grub screw or similar that passes through the material of the stationary frame component 4 and which with its tip applies pressure on the moving frame component 6, enabling the play of the moving frame component 6 in the stationary frame component 4 to be adjusted by turning the adjusting device 60 or the grub screw installed there.

As the result of the moving frame component 6 being guided with little play in the stationary frame component 4, the stationary frame component 4 and the foot attached to it at each side of the table are isolated as regards oscillations from the remaining structure of the table, i.e. from the table top, the table substructure 10 and the two moving frame components 6. Expressed more precisely, this means that unlike an arrangement with a near-zero-play and tight guide between the moving frame component 6 and the stationary frame component 4, in which the stationary frame component 4 and the stationary frame component 8 are incorporated in the oscillation system of the whole table, the guide according to the invention under discussion results in the isolation and hence effective damping of oscillatory movements of the table top mounted on the table substructure 10. If a table equipped with the linear or straight guide in accordance with the invention is struck in horizontal direction on one end of the table top, the table top makes an oscillatory movement with extremely intensive damping, i.e. the table top stands completely still again after a very short time, whereas on a table with a tight guide having as little play as possible between the moving frame component 6 and the stationary frame component 4 the table top continues to oscillate horizontally for a considerably longer period. This has been confirmed by comparative tests carried out within the framework of the invention under consideration.

To sum up, therefore, the linear or straight guide of the table in accordance with the invention has the following major characteristics and advantages:

As the result of guiding the moving frame component 6 in the stationary frame component 4 with slight play, the oscillations of a table top are quickly dampened.

Nevertheless, a table in accordance with the invention displays extreme stability when standing at rest because the moving frame component 6 is guided with sufficient stability thanks to the large-format guidance in the area of the surface sections 12 to 26 and 12' to 26' almost over the entire vertical height span of the stationary frame component 4, even when the moving frame component 6 is drawn out to the maximum height position.

The top end of the stationary frame component 4 does not change its height position when the height of the table substructure is changed; it is possible, therefore, to interlink several stationary frame components 4, in which case the individual table-substructures 10 and the table tops resting on them can be moved vertically independently of each other, and the interlink elements themselves remain on the same level. The overall self-contained impression of a series of interlinked tables is thus maintained.

By designing the stationary frame component 4 and the moving frame component 6 as accordingly contoured hollow profiles, it is possible to manufacture the frame components 4 and 6 economically in any desired length, e.g. by extrusion.

By separating the hollow spaces 48, 50 and 52 from each other as well as from the likewise separate cable ducts 56 and 58, the functional safety of the linear or straight guide is reliably maintained.

The guide ducts 56 and 58 are of large format and directly accessible when the panel 54 is removed, thus enabling cables, surplus lengths of cable or similar to be stored away neatly and systematically.

The description of the invention now under consideration was given in the light of the example arrangement and the drawing; many changes and modifications are possible, however, within the scope of this invention, some of which will be considered now:

The profile shaping of the stationary and moving frame component is not restricted, of course, to the arrangement illustrated by way of example. Different cross-sectional shapes are equally possible.

Nor is it essential to have a motor-driven height adjustment device; for many requirements it can be sufficient to provide for adjustment by hand, in which case provision should also be made for locking in position by clamping screws or similar since there will then be no motor-driven adjustment with self-arrest.

In the arrangement illustrated by way of example the cross-sections of the stationary frame components have roughly semicircular recesses; using appropriate adapters, angular rails or clamps that can be plugged into these recesses it is possible to locate monitor arms, telephone holders or similar at these points and it is possible to create horizontal linear or angular interlinks with further tables or table tops. With the fixture located on the stationary frame component, such auxiliary units or interlinked neighbouring elements are unaffected by height adjustments.

I claim:

1. A height-adjustable table comprising:

a generally horizontal table surface;

a linear guide located along a side of and below said table surface, including a stationary frame and a movable frame, for guiding vertical relative movement between said frames;

a connection between one of said frame and table surface;

each of said stationary frame and said movable frame being comprised of vertically extending closed hollow profiles, with one of said profiles being telescopically receivable within and completely enclosed by another of said profiles for guided relative movement of said frames;

guide surfaces carried by each of said stationary and movable frames cooperable with one another during relative telescopic movement thereof to substantially preclude relative movement between said stationary and movable frames in longitudinal and transverse directions generally parallel to said table surface;

each of said profiles having end edges, the end edges of said one profile being spaced inwardly from the end edges of said another profile to define between stationary and said moving frames a pair of generally vertically extending passageways extending substantially through the height of said guide.

2. A table according to claim 1 wherein said movable frame is guide in the stationary frame for telescopic movement relative to the stationary frame.

3. A table according to claim 1 wherein said guide surfaces of said stationary and movable frames have complementary surface portions including generally wedge-shaped portions in cross-section.

4. A table according to claim 1 wherein said stationary frame has at least one cable guide pocket formed on a side of the hollow profile of the stationary frame away from the hollow interior thereof.

5. A table according to claim 1 wherein at least portions of said guiding surfaces have an anti-friction covering.

6. A table according to claim 1 wherein said table has a longitudinal centerline, said guide having a vertical centerline and being offset from the centerline of said table whereby said guide is non-symmetrical relative to said table surface.

* * * * *